US005752451A

United States Patent [19]

Schaker et al.

[11] Patent Number: 5,752,451

[45] Date of Patent: May 19, 1998

[54] ASH CONTROL VALVE FOR A CIRCULATING FLUIDIZED BED COMBUSTOR

[75] Inventors: Yoram Schaker, South Windsor, Conn.; Joseph D. Dombrowski, Bethel Park, Pa.; Raymond C. Germain, Wilbraham, Mass.

[73] Assignee: Combustion Engineering, Inc., Windsor, Conn.

[21] Appl. No.: 762,518

[22] Filed: Dec. 9, 1996

Related U.S. Application Data

[62] Division of Ser. No. 533,570, Sep. 25, 1995, Pat. No. 5,642,676.

[51] Int. Cl.[6] ..... F23J 1/00

[52] U.S. Cl. ..... 110/165 R; 110/169

[58] Field of Search ..... 110/245, 249, 110/165 R, 165 A, 169

[56] References Cited

U.S. PATENT DOCUMENTS

| | | | |
|---|---|---|---|
| 1,758,157 | 5/1930 | James | 110/169 |
| 2,944,494 | 7/1960 | Mary | 110/165 |
| 3,933,103 | 1/1976 | Mikkelsen | 110/165 |
| 4,538,530 | 9/1985 | Whitman | 110/244 |
| 5,259,123 | 11/1993 | Garcia-Mallol | 110/245 |
| 5,642,676 | 7/1997 | Schaker et al. | 110/169 |

*Primary Examiner*—John T. Kwon

*Attorney, Agent, or Firm*—Robert S. Smith, Esq.

[57] ABSTRACT

An ash control valve apparatus, for use in a system that includes a fluidized-bed system, including a housing, a seat in the housing for passage of particulate material, a plug dimensioned and configured for mating engagement with the seat; and apparatus for moving the plug from a first position wherein the plug is disposed in seated engagement with the seat and a second position wherein the plug is disposed in spaced relationship to the seat. The apparatus for moving the plug includes apparatus for mounting the plug, that includes an elongated tube to which the plug is fixed. The apparatus for axially moving the tube includes a cylinder and piston assembly; and a clamp engaging the tube and operatively connected to the cylinder of the cylinder and piston assembly. In some forms of the invention the apparatus for mounting includes at least a one or two linear motion bearings and first and second shafts cooperating respectively with the first and second linear motion bearings as well as first and second beams disposed for supporting respectively the first and second shafts.

8 Claims, 5 Drawing Sheets

ASH CONTROL VALVE FOR A CIRCULATING FLUIDIZED BED COMBUSTOR

This application is a divisional of U.S. patent application Ser. No. 08/533,570 filed Sep. 25, 1995 which matured into U.S. Pat. No. 5,642,676 on Jul. 1, 1997.

TECHNICAL FIELD

The invention relates to circulating fluidized bed combustor apparatus and particularly to valves, including ash control valves for such apparatus. Circulating fluidized bed apparatus is being increasingly utilized for a wide variety of applications. The use of a circulating fluidized bed is particularly advantageous because of technological developments which have resulted in significant advances in both operating and fuel flexibility. The literature describes a wide variety of control valves for such apparatus.

The invention relates to fluidized bed apparatus and has particular application to fluidized bed combustion apparatus in steam generation apparatus. While the present invention has primary application to a combustion process in a steam generating system, it will be understood that the present invention may also be used in a wide variety of fluidized bed apparatus. Those skilled in the art will further recognize that fluidized beds have been used for decades in non-combustion reactions in which the thorough mixing and intimate contact of the reactants in a fluidized bed result in high product yield with improved economy of time and energy.

Fluidized bed combustion apparatus can burn coal efficiently at temperatures low enough to avoid many of the problems of combustion in other modes. The term "fluidized bed" refers to the condition in which solid materials are given free flowing, fluid-like behavior. As a gas is passed upward through a bed of solid particles, the flow of gas produces forces which tend to separate the particles from one another. At low gas flows, the particles remain in contact with other solids and tend to resist movement. This condition is referred to as a fixed bed. As the gas flow is increased, a point is reached at which the forces on the particles are just sufficient to cause separation. The bed is then deemed to be fluidized. The gas cushion between the solids allows the particles to move freely, giving the bed a liquid-like characteristic.

Fluidized bed combustion makes possible the burning of fuels having such a high concentration of ash, sulfur, and nitrogen that they would ordinarily be deemed unsuitable. By the use of this process it is possible, at least in most cases, to avoid the need for gas scrubbers while still meeting emissions requirements. In fluidized bed combustion, the fuel is burned in a bed of hot incombustible particles suspended by an upward flow of fluidizing gas. Typically the fuel is a solid such as coal, although liquid and gaseous fuels can be readily used.

The fluidizing gas is generally combustion air and the gaseous products of combustion. When fuel ash content is low or sulphur capture is not required, the fuel ash may be supplemented by inert materials such as sand to maintain the bed. In applications where sulphur capture is required, limestone is used as the sorbent and forms a portion of the bed. Two main types of fluidized bed combustion systems are (1) bubbling fluid bed (BFB) in which the air in excess of that required to fluidize the bed passes through the bed in the form of bubbles. The bubbling fluid bed is further characterized by modest bed solids mixing rate and relatively low solids entrainment in the flue gas and (2) circulating fluid bed (CFB) which is characterized by higher velocities and finer bed particle sizes. In such systems the fluid bed surface becomes diffused as solids entrainment increases, such that there is no longer a defined bed height. Circulating fluid bed systems have a high rate of material circulating from the combustor to the particle recycle system and back to the combustor. The present invention has particular application to circulating fluid bed boilers although those skilled in the art may recognize other applications. Characteristics of apparatus of this general type are further described in the publication Combustion Fossil Power, edited by Joseph G. Singer, P. E. and published by Combustion Engineering, Inc.; a subsidiary of Asea Brown Boveri, 1000 Prospect Hill Road, Windsor, Conn. 06095, 1991.

In a conventional circulating fluidized-bed steam generator crushed fuel and sorbent are fed mechanically or pneumatically to the lower portion of a combustor. Primary air is supplied to the bottom of the combustor through an air distributor, with secondary air fed through air ports at one or more elevations in the lower part of the combustor. Combustion takes place throughout the combustor, which is filled with fluidized bed material. Flue gases and entertained solids leave the combustor and enter one or more cyclones where the larger solids are separated and fall to a seal pot. From the seal pot, the solids are recycled to the combustor. Optionally, some solids may be diverted through a plug valve to an external fluidized-bed heat exchanger (FBHE) and back to the combustor. In the FBHE, tube bundles absorb heat from the fluidized solids.

A problem with many prior art valves is that their design allows particles to pass into spaces intermediate individual parts of a plug assembly part of the valve mechanism. The entrance of such particles is particularly a problem because the valve is manufactured of several different materials having different coefficients of thermal expansion. The entrance of the particles results in an effect that is colloquially called "sand jacking". This term refers to a phenomenon in which particles of material enter into minute crevices within the plug assembly. The minute crevices will ordinarily exist only when the components of the plug assembly are in the hot and hence expanded state. The combination of enormous temperature variations and differences in thermal coefficients of expansion result in distortions of the mechanism which must maintain precise alignment and fit for proper operation. More particularly, the temperature in the ambient of the valve is typically 1500 degrees Fahrenheit and thus the temperature of the mechanism is approximately 1500 degrees Fahrenheit!

A further aspect of the very high temperatures is that particular care must be taken to properly seal the valve mechanism outside the valve body from the high temperatures within the valve body. Some known valves have included stuffing boxes to seal around a shaft which carries a plug member that cooperates with a seat. The known stuffing boxes have not been wholly satisfactory.

Another problem with many prior art valves used in such applications is that the service life, the operating life before a mechanical failure, is unsatisfactorily short. This is particularly significant because such mechanical failures result in time consuming maintenance during which the entire circulating fluidized bed combustor and associated apparatus cannot be operated. This is of great importance because of the economic pressures to maximize the utilization of such apparatus and the criticality of continuous operation of the apparatus.

It will be further understood that a problem with other known valves for such applications is that the precise, easy and smooth movement of the plug portion of the valve mechanism is essential to the long term satisfactory operation of the valve. At least some of the prior art valves for such applications have not adequately provided for such operation.

The particulate matter to be controlled has an enormous volume and weight. It is estimated that during normal operation of the circulating fluidized bed apparatus the weight of the particulate matter will be between 400,000 and 2.2 million pounds per hour! It will thus be seen that the valve environment is harsh.

OBJECTS AND SUMMARY OF THE INVENTION

A primary object of the invention is to provide apparatus that is able of handling the enormous quantity of material in an environment that is extremely hot and harsh.

An object of the invention is to provide an ash control valve for a circulating fluidized bed combustor that has a longer service life than known valves for such applications.

Another object of the invention is to provide a valve that is configured to prevent the entrance of materials into crevices and interstices of the valve mechanism.

Still another object of the invention is to provide apparatus that will insure precise, easy and smooth movement of the plug portion of the valve mechanism.

Yet another object of the invention is to provide an improved control stuffing box configuration.

Another object of the invention is to increase the operating flexibility of the circulating fluidized bed unit in which the valve is installed.

SUMMARY OF THE INVENTION

It has now been found that these and other objects of the invention may be attained in an ash control valve apparatus for use in a system that includes a fluidized-bed system which includes a housing, a seat in the housing for passage of particulate material, a plug dimensioned and configured for mating engagement with the seat, and means for moving the plug from a first position wherein the plug is disposed in seated engagement with the seat and a second position wherein the plug is disposed in spaced relationship to the seat. The means for moving the plug includes means for mounting the plug. The means for mounting the plug includes an elongated tube to which the plug is fixed. The means for mounting includes a plurality of axially extending ribs disposed on the circumference of the elongated tube and a plurality of channels disposed in a bore in the plug, means in the plug cooperating with the plurality of channels to define a bayonet type receiving structure dimensioned and configured for receiving the plurality of axially extending ribs and allowing relative rotational movement between the plug and the ribs to produce locking engagement therebetween.

In some forms of the apparatus the means for cooling the tube includes a concentric hollow internal member for directing flow of a coolant alone the axial extent of the tube. A portion of the tube may extend through a wall of the housing opposite the seat; and a bonnet assembly may surround the axial portion of the tube extending through a wall of the housing, the bonnet assembly insures a dynamic seal between the tube and the bonnet assembly as the tube is moved axially in the direction of the first position for second position.

The apparatus may include means for axially moving the tube which includes a cylinder and piston assembly and a clamp engaging the tube and operatively connected to the cylinder of the cylinder and piston assembly. In some embodiments the means for mounting includes at least a first linear motion bearing. The means for mounting may further includes a second linear motion bearing. Some forms of the means for mounting further include first and second shafts cooperating respectively with the first and second linear motion bearings. The means for mounting may further includes first and second beams disposed for supporting respectively the first and second shafts and the bonnet assembly may includes a lantern ring and means for cooperation with a fluid source to provide improved sealing.

In some forms of the invention the housing has a wall opposite the seat through which the shaft passes that is generally oblique to the shaft. The housing may be lined with a refractory material such as a calcium aluminate material.

BRIEF DESCRIPTION OF THE DRAWING

The invention will be better understood by reference to the accompanying drawing in which.

DESCRIPTION OF THE PREFERRED EMBODIMENT

Figure 1:
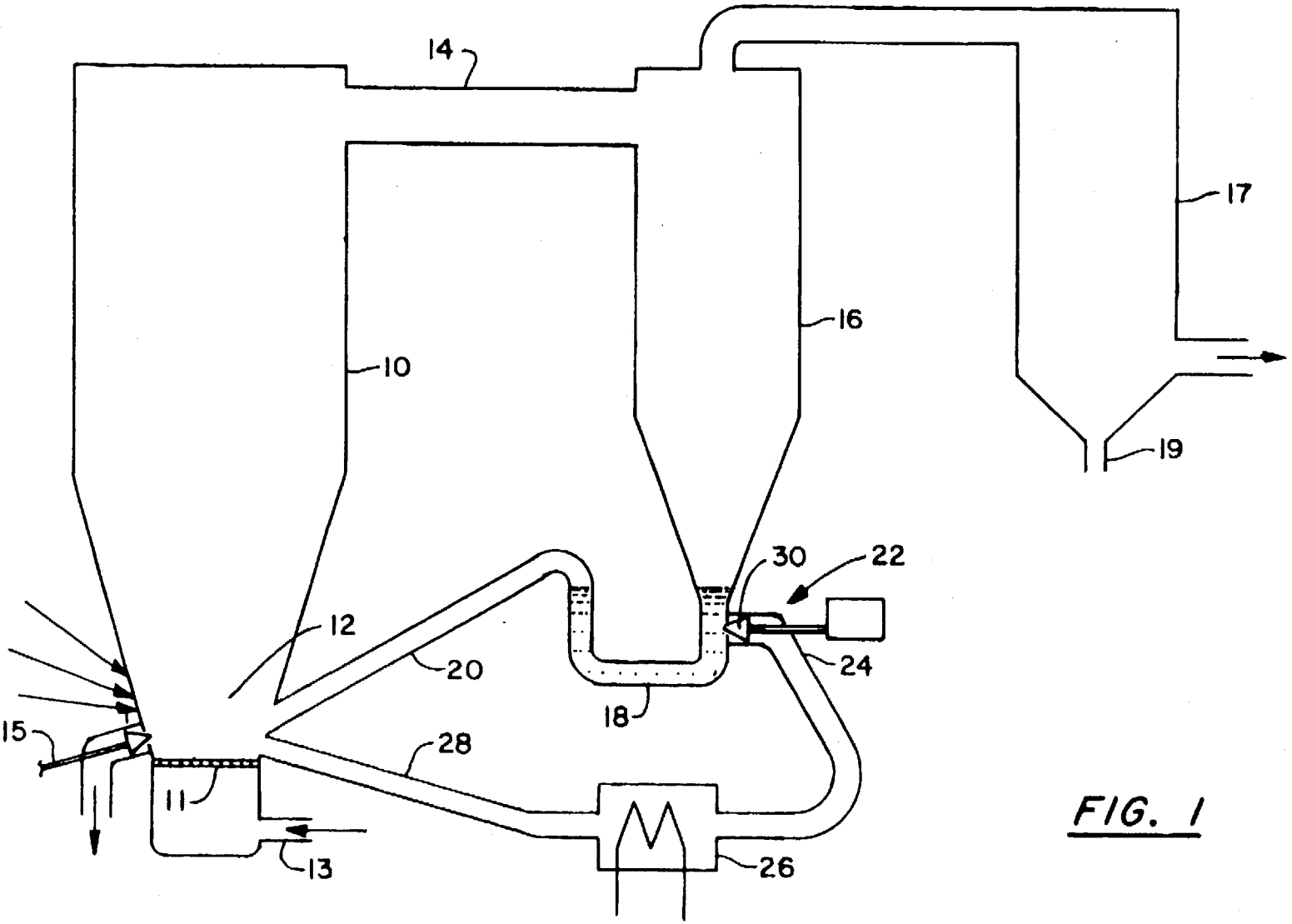
FIG. 1 is a partially schematic elevational view of a circulating fluidized bed combustor apparatus that incorporates one or more of the control valves in accordance with the present invention.

Referring now to the overall schematic of FIG. 1 as well FIGS. 2–6 there is shown a vertically elongated combustor 10 in which is disposed a circulating fluidized bed 12. The circulating fluidized bed 12 is disposed on a base plate 11. Primary air is supplied to the bed 12 through a port 13 disposed below the base plate 11. Secondary air, limestone and fuel are directed into the side of the bed 12 as indicated by the three arrows on the left side (as viewed) of the combustor 10. The air, limestone, and fuel in the bed 12 react in a combustion process within the combustor. The fuel typically is a fossil fuel. The limestone is a sorbent. A bottom ash control valve 15 is also disposed on the left side of the combustor 10. This valve will be described in greater detail hereafter. The purpose of the bottom ash control valve 15 is to allow the exit of ash from the bed 12. Typically, the bottom ash that is passed through the bottom ash control valve 15 is cooled and thrown away.

The particles in the circulating fluidized bed 12 are recirculated through a gas pass 14 to one or more cyclones 16 (one shown). Each cyclone 16 is vertically elongated and has the lower extremity connected to a seal pot 18. The top of each cyclone 16 is coupled to a back pass 17 that contains additional heat transfer surfaces. The arrow indicating movement out of the back pass 17 indicates flue gas flow to a dust removal apparatus and a stack (not shown). Additional ash is removed from the lower extremity 19.

Each seal pot 18 has a shape and function somewhat comparable to the trap commonly connected to the drain of residential and commercial sinks. The seal pot 18 is coupled to the combustor 10 by a first return duct 20. An ash control valve 22 modulates flow out of the seal pot 18 through a refractory lined housing 24 that is coupled to a heat exchanger 26 and a second return duct 28. The second return duct 28 completes the path from the seal pot 18, through the heat exchanger 26 to the combustor 10. The first and second return ducts 20, 28, as well as the seal pot 18, are refractory lined.

It will be understood that the seal pot 18 is typically filled with particulate material that acts much like a liquid. Particulate matter that is present in the flue gases exiting the combustor 10 is separated in the cyclone(s) 16. Because the particulate matter is separated from the flue gases in the cyclone 16, the particulate matter may be disposed at a greater height in the leg of the seal pot 18 that is aligned with the cyclone 16 than in the leg of the seal pot 18 that is vertically disposed and coupled to first return duct 20. In other words, it will be understood that there is a "head" inherent in the higher column directly below the cyclone 16 that urges movement of the particulate matter through the seal pot 18 and into the first return duct 20. Accordingly, there is flow of particulate matter from the cyclone 16 to the bed 12 even though flue gas cannot pass through the seal pot 18 from the combustor 10 to the cyclone 16. A relatively low flow of high pressure air is supplied along the bottom of the seal pot 18 to fluidize and hence assist in the flow of particulate matter.

The fluid pressure at the lower end of the combustor 10, where the return duct 20 is joined thereto, is about thirty inches of water. The pressure at the bottom of the cyclone 16 is about zero inches of water. If the bottom of the cyclone 16 were coupled directly to the lower extremity of the combustor, with no intervening seal pot 18 filled with particulate matter, gases would flow from the relatively high pressure combustor 10 to the relatively low pressure cyclone 16.

Typically, a sensor (not shown) in the combustor 10 cooperates with a control (not shown) to modulates the ash control valve 22 to maintain a desired temperature in the combustor 10. The control system may vary for the specific application. In general, the opening of the ash control valve 22 causes movement of the particulate matter or ash through the bypass loop that includes the heat exchanger 26. Because the heat exchanger 26 will extract some heat from the ash or particulate material, the temperature in the combustor 10 will be lower because the large mass of particulate matter passing into the combustor will be cooler than if the particulate material had passed through the seal pot without the cooling that will occur in the heat exchanger 26. Typically, the control system for the ash control valve 22 will modulate the valve to control the temperature in the combustor 10. Those skilled in the art will understand that the specific control system will vary with the application associated with the heat transfer elements in the heat exchanger 26.

Figure 2:
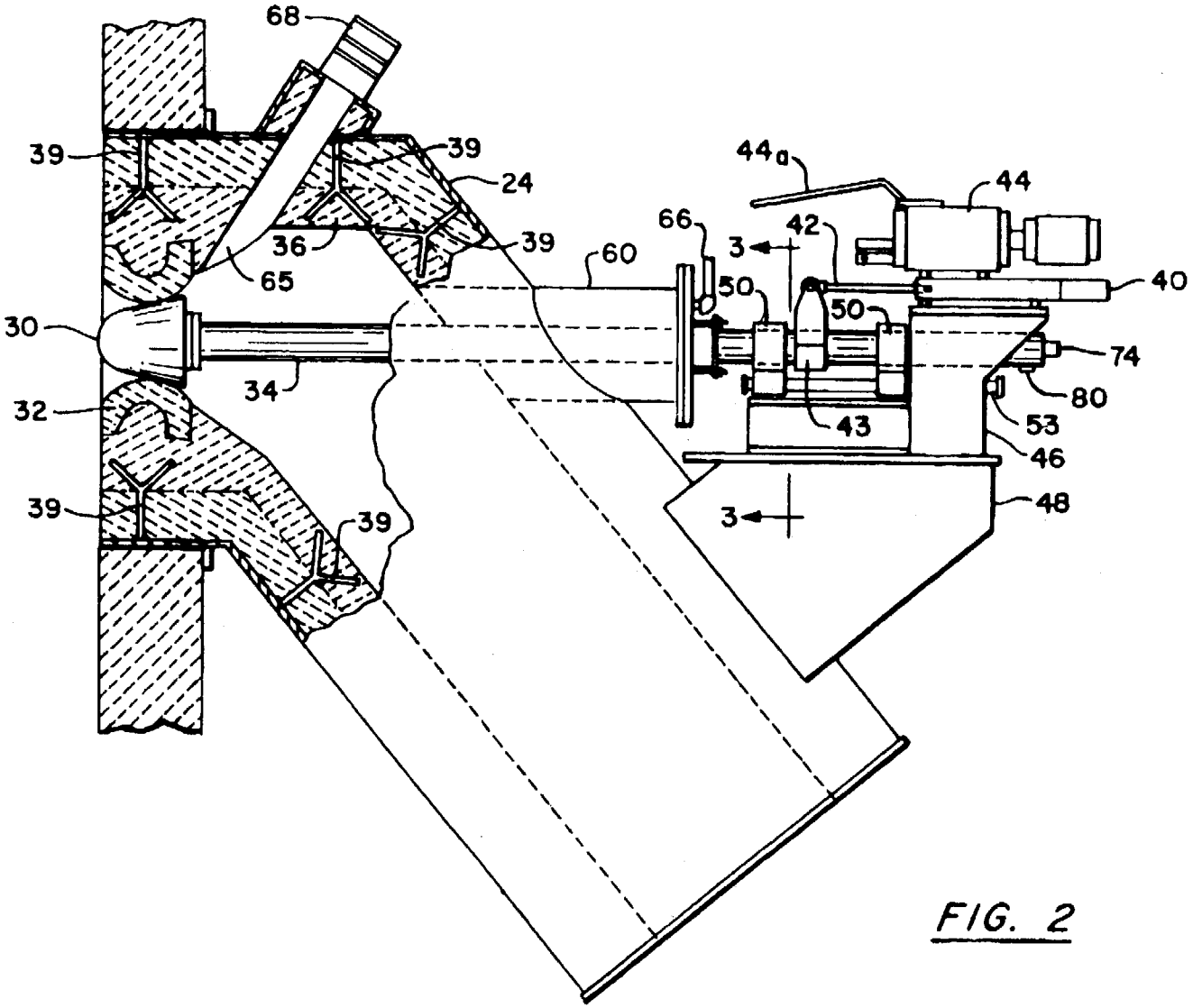
FIG. 2 is an axial cross-sectional view of a preferred form of the ash control valve in accordance with the present invention.

The valve 22 includes a metallic head or plug 30 that cooperates with a seat 32 best illustrated in FIG. 2. The contour of the seat 32 includes a generally circular opening that functions like a venturi. The plug 30 is carried on a tube 34. As best seen in FIG. 2 the tube 34 passes through the wall of the housing 24. The wall of the housing 24 is lined with refractory material 36 that is positioned in place by Y-shaped members 39. A bonnet 60 is disposed in concentric relationship with the tube 34 at an axial portion thereof that passes through the wall of the housing 24.

Because of the importance of precise, easy and smooth movement of the plug 30 the tube 34 is moved axially with respect to the seat 32 by a hydraulic cylinder having a piston 42 coupled by a pin to a collar 43 that is coupled to the shaft 34. The cylinder 40 is supplied high pressure hydraulic fluid from a pump, motor and hydraulic fluid reservoir assembly 44. The assembly 44 includes a handle **44*a* for hand pump operation. The hand pump operation is provided for use in the event of failure of the power system and to facilitate adjustment of the system. The cylinder 40 is fixed to a support 46 that is fixed to a base 48 that is fixed to the housing 24**. Hydraulic actuation is preferred because of the inherently greater power transmission of hydraulic systems as opposed to pneumatic systems. Although the preferred embodiment includes a hydraulic cylinder, it will be understood by those skilled in the art that other embodiments may have a pneumatic cylinder without departing from the spirit of the invention. Still other embodiments may include a rack and pinion construction or other constructions more suited for electric motor operation.

Figure 3:
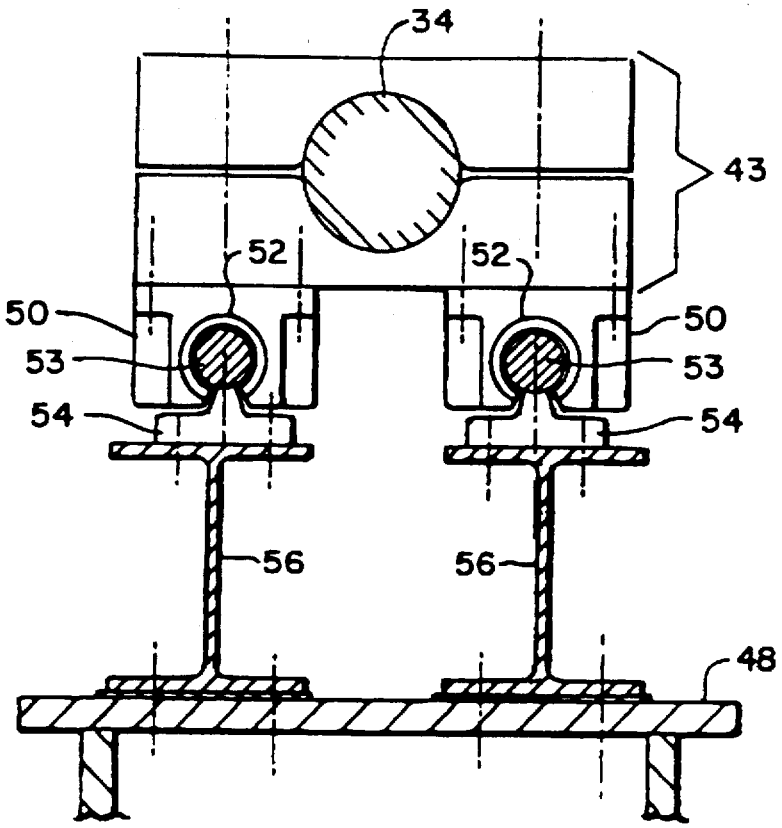
FIG. 3 is a partially cross-sectional view taking along the line 3—3 of FIG. 2.

The tube 34 is clamped within first and second clamps 50, 50 that have respective cylindrical cross-section channels 52, 52 in which are disposed ball bushing linear bearings. Bearing systems of this general type include the Series XR® ball bushing bearings manufactured by Thomson Industries, Inc. The channels 52, 52 ride respectively on bars 53, 53 that are carried on respective parallel beams 54, 54 mounted in parallel relationship on parallel I-beams 56, 56 mounted on the base 48 as best seen in FIG. 3.

Figure 4:
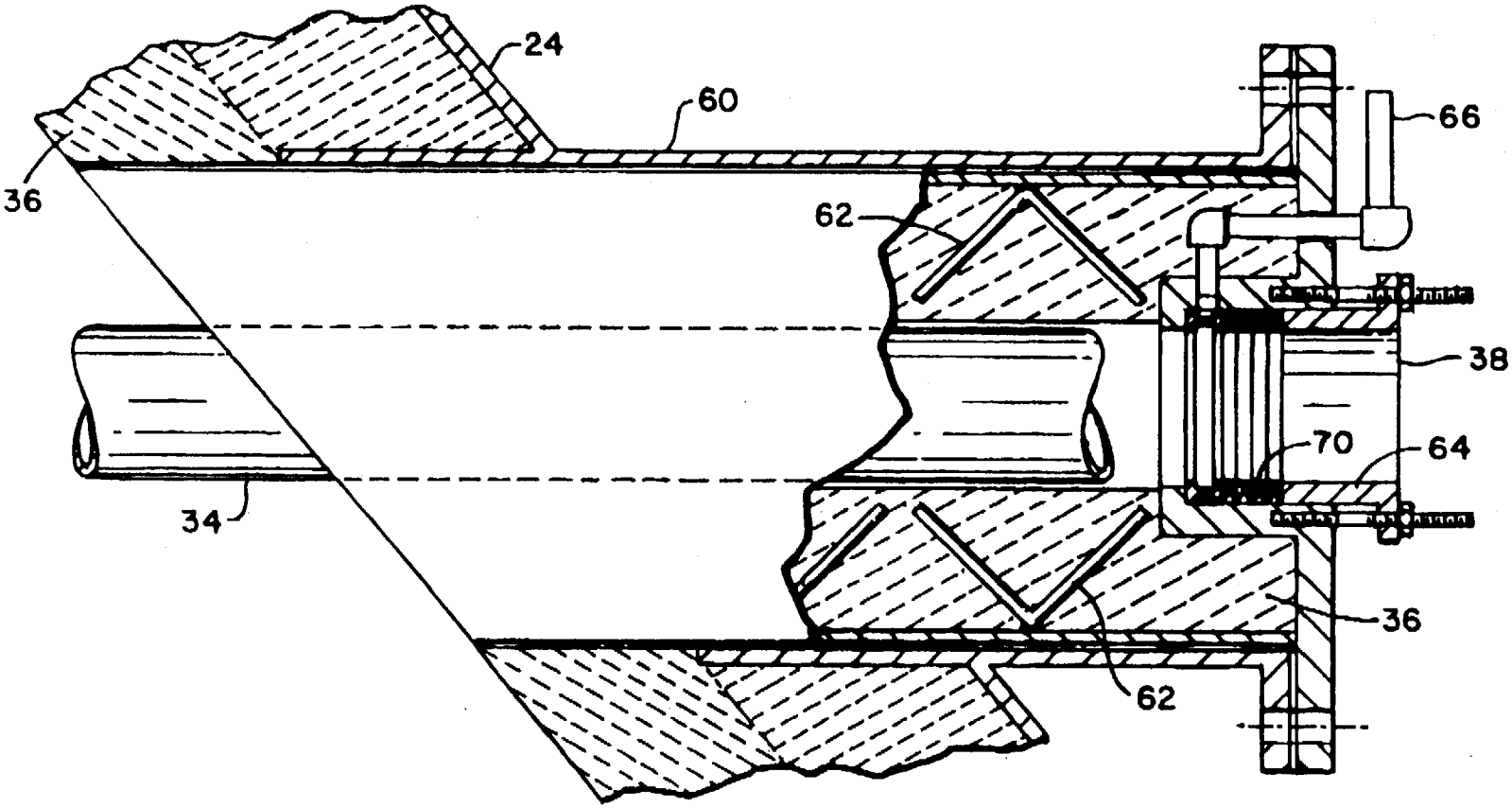
FIG. 4 is a partially sectional view of the bonnet assembly surrounding the axial portion of the tube extending through a wall of the housing.

The very high temperatures in the ambient of the valve 22 require various special features. The bonnet 60 surrounds the part of the tube 34 that passes out of the housing 24 as best seen in FIGS. 2 and 4. The bonnet 60 is a cylindrical body obliquely intersecting the housing 24. The wall of the bonnet 60 is lined with refractory material 36 that is positioned in place by V-shaped members 62. The bonnet 60 must isolate the extremely high temperatures within the housing 24 from the ambient temperature. A lantern ring assembly or stuffing box 38 is provided for this purpose. The lantern ring assembly 38 comprises a sleeve 64 having an exterior circumferential groove and an internal groove that are essentially at the same axial point on the sleeve 64. Passageways extending radially intermediate the exterior and interior grooves allow passage of gas therebetween. Cooling air is provided through a pipe 66 which directs the cooling air initially to the exterior groove and then to the radial passageways and the interior groove. In this manner the passage of coal dust or the like out of the combustor 10 is prevented. Those skilled in the art will recognize that the lantern ring assembly 38 is secured by studs to a plate that engages the flange of the bonnet 60.

An advantage of the lantern ring assembly 38 is that conventional commercially available packing 70 may be satisfactorily used. In other words, this design does not require custom seals. An inspection port 66 is provided in the housing 24 with a sight glass 68.

Figure 5:
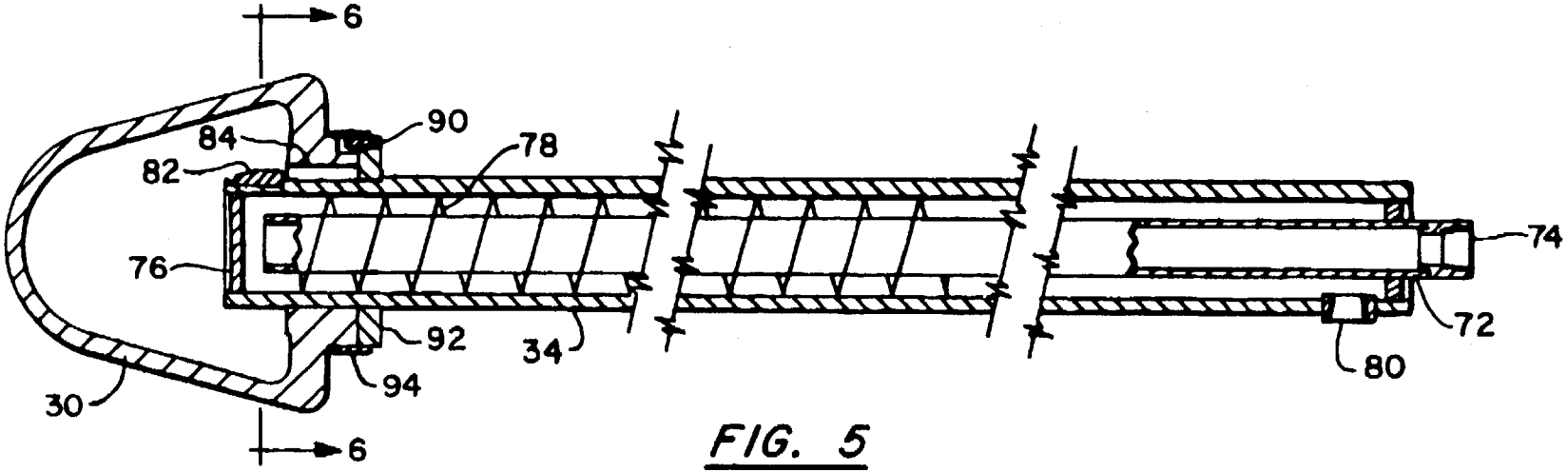
FIG. 5 is an axial cross-section view listening in greater detail the tube mounting to which the valve plug is next.
Figure 6:
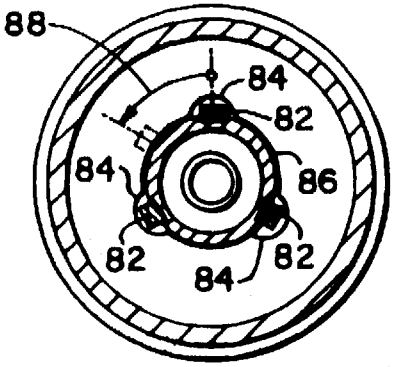
FIG. 6 is a cross-section view taken along the line 6—6 of FIG. 5.

The tube 34 is provided with an internal cooling water flow by means of a concentric tube 72 as best seen in FIGS. 5 and 6. The concentric tube 72 is provided with an inlet connection 74 for cooperation with a cooling water supply (not shown). The cooling water passes through the entire length of the tube 72 until it is blocked by a plate 76 that seals the left end of the tube 34 and thus forces the cooling water tube to flow to the right (as viewed) intermediate the tube 72 and the tube 34. A helix shaped member 78 that surrounds substantially the entire axial extent of the tube 76 maximizes heat transfer from the tube 34 to the cooling water. In other words, the helix shaped member maximizes cooling of the tube 34. An outlet fitting 80 in the tube 34 directs the flow of cooling water after it has passed through the entire axial extent of the tube 72 and then back through the annular space intermediate the tubes 34 and 72.

A further feature of the present invention is intended to prevent ash or other particulate matter from entering crevices of the apparatus. As shown in FIGS. 5 and 6 the coupling between the plug 30 and the tube 34 is a bayonet construction. More particularly, the tube has, in the preferred embodiment, three axially extending ribs 82, 82, 82 at are equally spaced about the circumference of the tube 34. The ribs 82, 82, 82 cooperate respectively with three arcuate channels 84, 84, 84 that are equally spaced about a bore 86 in the plug 30. Thus, as the tube 34 is inserted into the bore 86 the alignment of the elements is as shown in solid line in FIG. 6. Engagement is completed by relative rotation of the plug 30 with respect to the tube 34 to the position shown in dotted line in FIG. 6. An arrow 88 further indicates the movement required for engagement.

After this rotation has been accomplished, a key 90 is inserted in axially extending keyway that extends from the plug 30 to a plate 92. The plate 92 is welded to the tube 34. Thus, the key 90 prevents relative movement between the plug 30 and the plate 90/tube 34. Preferably, a cover 94 which is substantially a cylindrical section is welded over the key 90 to prevent inadvertent movement of the key 90. The cover 94 also prevents passage of ash or other particulate material into the interface between the plug 30 and the tube 34.

In the preferred embodiment the bottom ash control valve 15 is identical to the valve 22. Accordingly, no further description is necessary other than to note that the control system will differ.

The seat 32 is manufactured of silicon carbide tile in the preferred embodiment. The refractory material 34 is preferably a calcium aluminate bonded refractory castable. Preferably the characteristics for the portion thereof nearest the flow channel are different from the composition nearest the wall of the housing. The former is characterized as the service lining and the latter is characterized as the insulating lining. The characteristics are as follows:

| Property | Insulating Lining | Service Lining |
|---|---|---|
| $Al_2O_3$ | >30% | >25% |
| $SIO_2$ | >45% | >60% |
| $Fe_2O_3$ | <1.5% | <1.5% |
| Dried Density | <60 pcf | <125 pcf |
| Permanent Linear Change (max. absolute value) | −0.8% | −0.15% |
| Cold Crushing Strength | >300 psi | >7,000 psi |

-continued

| Property | Insulating Lining | Service Lining |
|---|---|---|
| Abrasion Resistance (ASTM C704) | n.a. | <12.0 cc |
| Method of Installation | gun or cast | vib. cast |

The invention has been described with reference to its illustrated preferred embodiment. Persons skilled in the art of such devices may, upon exposure to the teachings herein, conceive other variations. Those skilled in the art will recognize such variations. Such variations are deemed to be encompassed by the disclosure, the invention being delimited only by the following claims.

Having thus described are invention, we claim:

1. An ash control valve apparatus, for use in a system that includes a fluidized-bed system, which comprises:

a housing;

a seat in said housing for passage of particulate material;

a plug dimensioned and configured for mating engagement with said seat; and means for moving said plug from a first position wherein said plug is disposed in seated engagement with said seat and a second position wherein said plug is disposed in spaced relationship to said seat;

said means for moving said plug including means for mounting said plug, said means for mounting said plug including an elongated tube to which said plug is fixed, said means for axially moving said tube includes a cylinder and piston assembly; and a clamp engaging said tube and operatively connected to the cylinder of said cylinder and piston assembly.

2. The apparatus as described in claim 1 wherein:

said means for mounting includes at least a first linear motion bearing.

3. The apparatus as described in claim 2 wherein:

said means for mounting further includes a second linear motion bearing.

4. The apparatus as described in claim 3 wherein:

said means for mounting further includes first and second shafts cooperating respectively with said first and second linear motion bearings.

5. The apparatus as described in claim 2 wherein:

the apparatus for mounting further includes first and second beams disposed for supporting respectively the first and second shafts.

6. The apparatus as described in claim 5 wherein:

said bonnet assembly includes a lantern ring and means for cooperation with a fluid source to provide improved sealing.

7. The apparatus as described in claim 6 wherein:

said housing has a wall opposite said seat through which said shaft passes that is generally oblique to said shaft.

8. The apparatus as described in claim 7 wherein:

said housing is lined with a refractory material.

* * * * *